United States Patent [19]

Bastian

[11] Patent Number: 4,805,365

[45] Date of Patent: Feb. 21, 1989

[54] CORNER POST ASSEMBLY

[75] Inventor: John M. Bastian, Manitowoc, Wis.

[73] Assignee: Hamilton Industries, Inc., Two Rivers, Wis.

[21] Appl. No.: 128,687

[22] Filed: Dec. 10, 1987

[51] Int. Cl.[4] ..... E04B 2/56; E04C 3/30

[52] U.S. Cl. ..... 52/282; 52/738

[58] Field of Search ..... 52/36, 239, 282, 738

[56] References Cited

U.S. PATENT DOCUMENTS

| | | | |
|---|---|---|---|
| 3,866,364 | 2/1975 | Pollard | 52/36 |
| 4,021,973 | 5/1977 | Hegg et al. | 52/36 |
| 4,101,231 | 7/1978 | Streib | 52/282 X |
| 4,104,838 | 8/1978 | Hage et al. | 52/282 X |
| 4,356,672 | 11/1982 | Beckman et al. | 52/36 |
| 4,388,786 | 6/1983 | Gassler | 52/282 |
| 4,606,394 | 8/1986 | Bannister | 52/738 X |

*Primary Examiner*—J. Karl Bell

*Attorney, Agent, or Firm*—Tilton, Fallon, Lungmus

[57] ABSTRACT

A corner post assembly particularly useful for joining vertical panels, frames, and the like, in constructing modular work stations for laboratories, offices, and industrial sites. The assembly includes a corner post tube typically having two or more (but at least one) vertically-elongated risers secured to the tube at selected angular positions thereabout. The corner post tube has a plurality of outer bearing faces which, when viewed in a horizontal cross-section of that tube, define a regular polygon in which the included angles between adjacent faces are equal and obtuse. Each vertical riser, which may be a frame component of a partition or movable wall assembly, is releasably but securely connected to the tube at three vertically and laterally spaced traction points, with the planar wall of the riser held in tight surface engagement with one of the bearing faces of the tube.

12 Claims, 4 Drawing Sheets

CORNER POST ASSEMBLY

BACKGROUND AND SUMMARY

The prior art contains a number of examples of space-dividing panel systems in which corner post assemblies are used, such patents including, for example, U.S. Pat. Nos. 3,086,627, 3,462,110, 3,841,042, 3,886,698, 4,021,973, 4,446,669, 4,493,172, 4,601,145, 4,601,146, and 4,638,614. In general, the corner posts of such assemblies are generally cylindrical in shape so that if forces tending to twist or rotate a panel in relation to the post are to be resisted, that portion of the panel in contact with the post is ordinarily provided with an arcuate face matching the cylindrical contour of the post. In some constructions, such as those disclosed in U.S. Pat. Nos. 4,021,973 and 4,493,172, the cylindrical posts are grooved and the connecting members of the panels are provided with rails that extend the full height of the grooves (or the full height of each panel) to help brace the connections between the parts. Among the shortcomings of such a construction is the disadvantage that during assembly of the parts the elongated rail members, and possibly the panels to which they are affixed, must be slid into engagement with the corner post tubes along the full length of the grooves. Unless the ceiling height of a room is more than double the height of the corner post, the post and rails to be connected to it must be laid on their sides in order to permit such assembly. Also, in U.S. Pat. No. 4,021,973, the side rails are urged into the grooves by traction force applied at a central point and, since the zones of contact work in opposition, should there be a failure at the central point the entire assembly becomes loosened.

Prior space-dividing panel systems often do not permit the corner posts to be connected to panels having a variety of vertical dimensions and designs. Such assemblies are frequently complex and utilize components requiring relatively expensive manufacturing operations. As already indicated, assembly is sometimes difficult, particularly if size (height) variations are to be accommodated, and the connecting elements, if concealed from view in the completed construction, may be awkward to reach when disassembly or repositioning of the space-dividing structure is required.

Accordingly, an important aspect of this invention lies in providing a construction that facilitates the secure attachment of risers of the same height or different heights to a corner post tube. Grooves are provided in the outer surface of the tube for that purpose but, in making such a connection, a user draws the parts laterally together in contrast to the prior practice of sliding a rail member into position along substantially the full length of the grooves from the upper or lower end of the corner post. The risers, and the panels or frames to which they may be attached, may be secured to the corner post tube at angular positions that are multiples of 30 degrees with any two adjacent risers being at least 90 degrees apart. A wide variety of arrangements, with risers of the same or different lengths and at any of a variety of angular positions, may therefore be readily obtained.

Each riser is secured to the corner post tube at three traction points; specifically, two laterally-spaced lower points and a single centrally-disposed upper point. Although the connecting means at such traction points are partially concealed, such means are readily accessible for ease of assembly and disassembly of the parts. The corner post tube is of polygonal cross section and, when the connecting means are tightened at the three traction points, the planar wall of each riser is drawn into tight surface engagement with one of the planar bearing faces of the tube.

Briefly, the corner post assembly includes a straight, vertically-elongated corner post tube having a plurality of outer bearing faces which, when viewed in a horizontal cross section of the tube, define a regular polygon in which the angle between each adjacent pair of faces is greater than 90 degrees. Each face has a vertical channel or keyway formed therein with each channel being externally accessible through a relatively narrow entry slit extending along and between a pair of side flanges.

Both the corner post tube and the body of the vertical riser are advantageously and relatively inexpensively formed by extrusion. The means for securing a riser against one of the bearing faces of the tube at three spaced traction points takes the form of an upper draw member movably mounted at the upper end portion of the riser for limited horizontal movement between extended and retracted positions, the draw member projecting through the entry slit of one of the channels and having an enlarged head portion received within that channel. The side flanges prevent the head portion from being horizontally retracted from the channel but, until retractive forces are exerted, the draw member is vertically slidable along that channel.

The lower connecting means comprises a pair of laterally-spaced support members with head portions received in two channels adjacent to, and on opposite sides of, the channel receiving the upper draw member. Such support members are attached to the riser adjacent the lower end thereof and are mounted for limited movement between extended and retracted positions. Therefore, when the two lower support members and the upper draw member are retracted, the planar wall of the riser is drawn into tight surface engagement with a planar bearing face of the corner post tube to anchor the parts tightly together.

Other features, advantages, and objects of the invention will become apparent from the specification and drawings.

DRAWINGS

Figure 11:
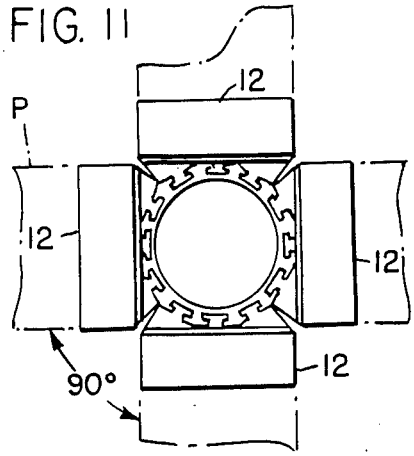
Figure 8:
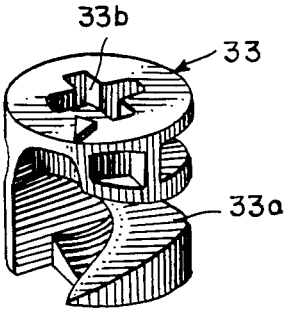
FIG. 8 is a perspective view of a camming element preferably used in retracting and extending the draw member at the upper end of the riser.
Figure 12:
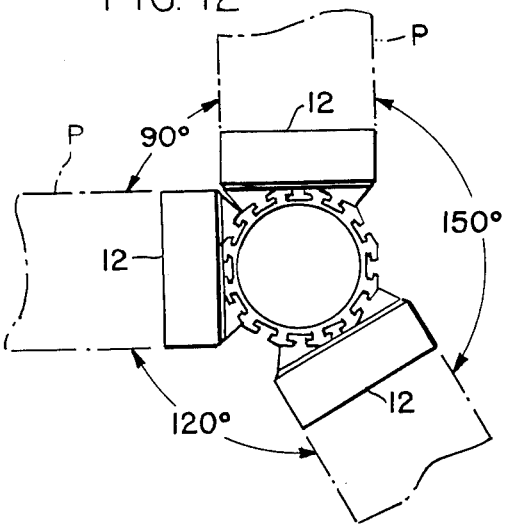
Figure 9:
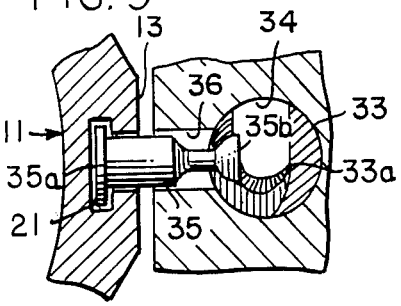
FIGS. 9 and 9A are horizontal sectional views illustrating the coaction of the camming element and draw member before the draw member is retracted or tightened.
Figure 9A:
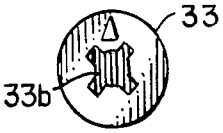
Figure 13:
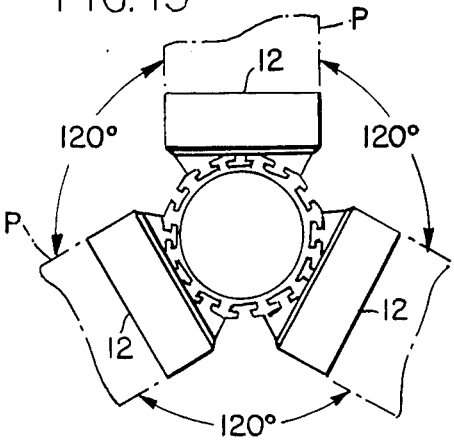

FIGS. 11, 12, and 13 are fragmentary and somewhat schematic top views illustrating different arrangements in which a plurality of risers may be joined to a single corner post tube.

DETAILED DESCRIPTION OF PREFERRED EMBODIMENT

Figure 1:
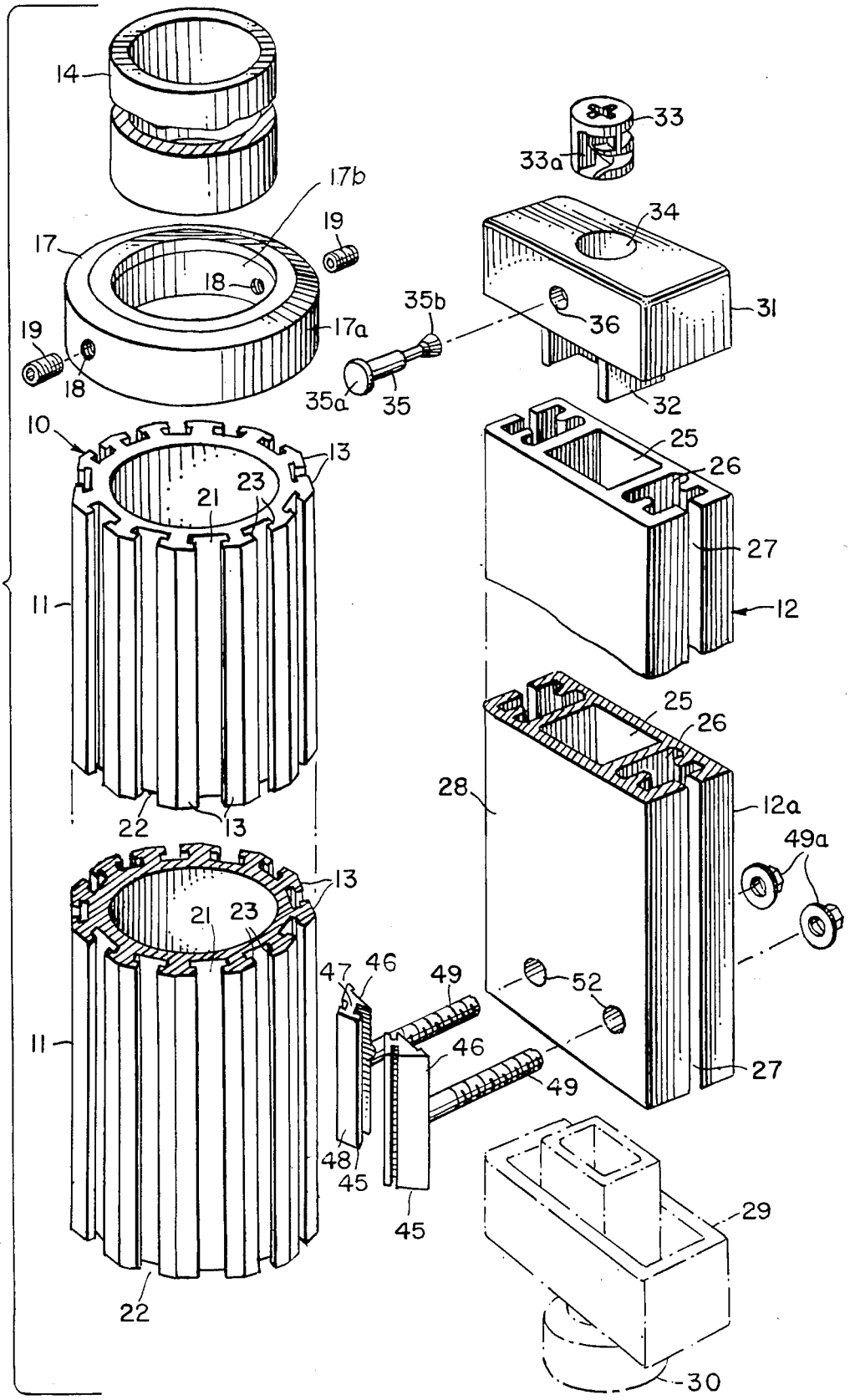
FIG. 1 is an exploded fragmentary perspective view illustrating the major components of a corner post assembly embodying this invention.
Figure 2:
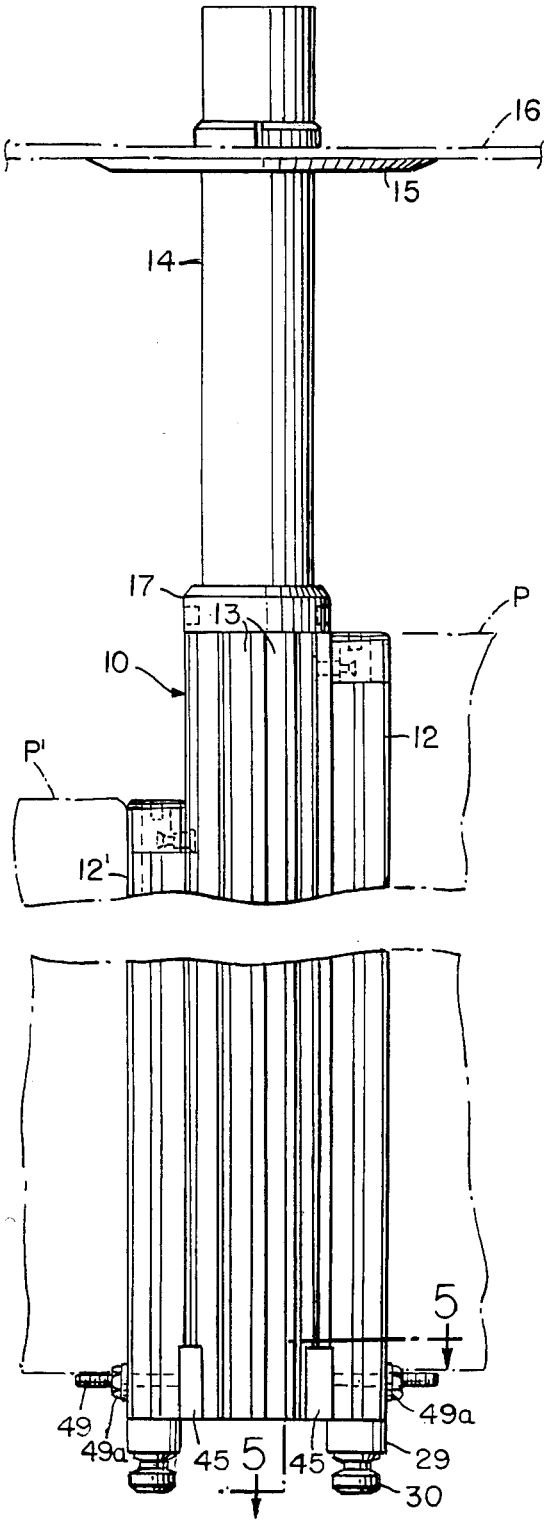
FIG. 2 is a fragmentary side elevational view of such an assembly.
Figure 3:
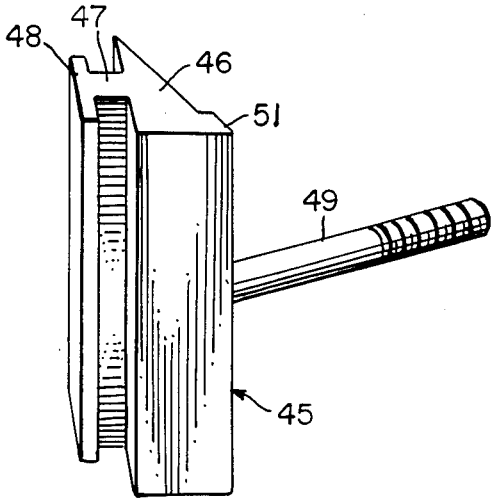
FIG. 3 is an enlarged perspective view of one of the lower support members.

Referring to FIGS. 1 and 2, the numeral 10 generally designates a corner post assembly that includes a corner post tube 11 and one or more vertical risers 12. In FIG. 2, two such risers 12, 12' depicted and a greater number (up to 4 in this embodiment) may be provided. It is to be understood that all such risers are of identical construction and differ only in their length (height). Each riser may extend the full height of the tube 11 or may have any selected length less than that of the tube. The term "riser" is used here to mean a vertical member that would ordinarily be a component of a panel or frame structure intended to be connected to and supported by the corner post assembly. For example, in FIG. 2, risers 12 and 12' constitute the vertical side members of panel structures P and P', respectively. Whether the structure constitutes an open panel, a closed panel, or is used for screening or to provide support for shelving or furniture components, is not material to this disclosure. Panel structures and their uses are well known in the art and, for purposes of describing this invention, it is believed sufficient to point out that the utility of the riser lies in the fact that it constitutes the side member of what might otherwise be a conventional panel or frame structure.

Figure 5:
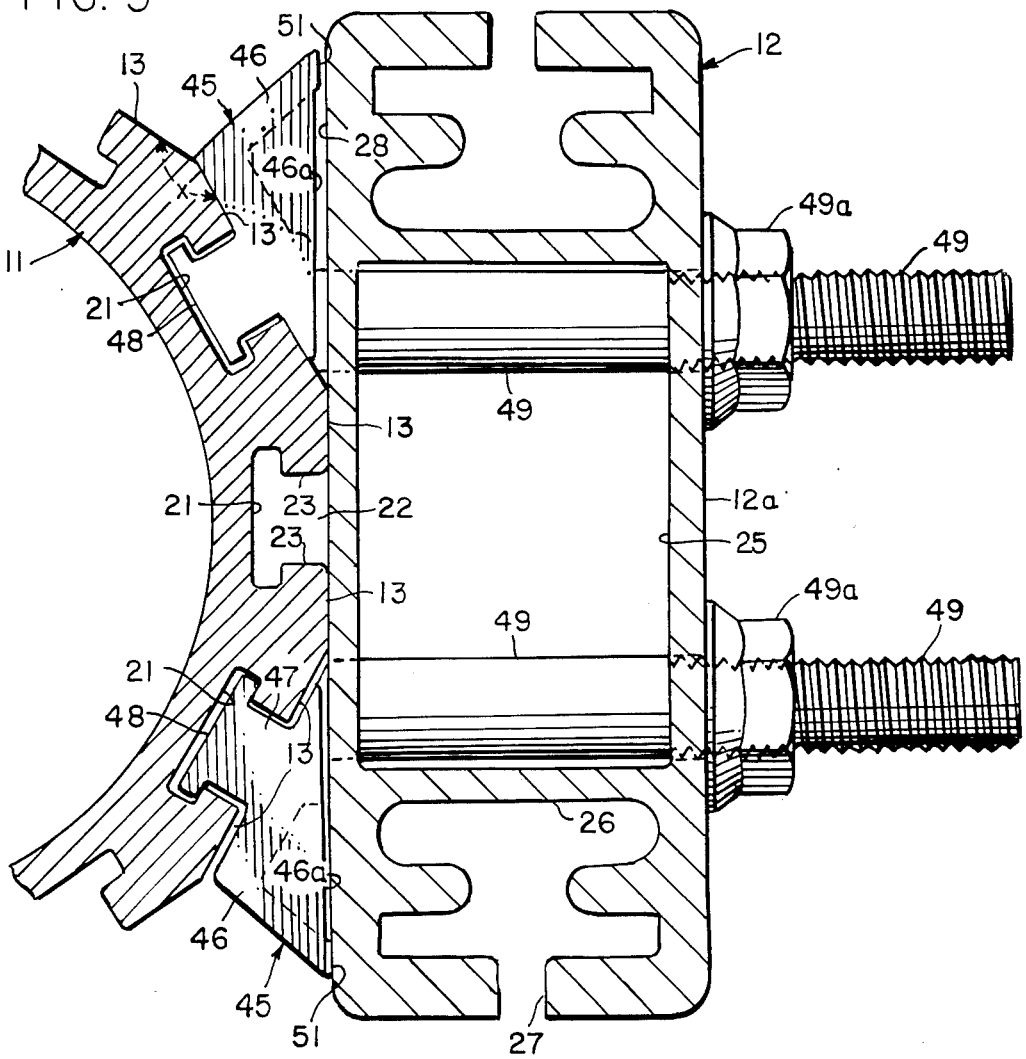
FIG. 5 is an enlarged cross sectional view taken along line 5—5 of FIG. 2 and showing one lower support member in loosened condition and the other lower support member in partially tightened condition.

The corner post tube 11 is straight, vertically-elongated, and has a plurality of outer bearing faces 13 which, when viewed in a horizontal cross-section of the tube, define a regular polygon in which the included angles x between adjacent faces are equal and obtuse (FIG. 5). Ideally, the tube has 12 such planar bearing faces since, as explained more fully hereinafter, that allows risers to be connected to the tube at angular increments that are multiples of 30 degrees but with adjacent risers no closer than 90 degrees (FIGS. 11–13). However, it is to be understood that different regular polygonal cross-sectional configurations may be selected with any number of faces in excess of 4 so that, in any event, the included angle between adjacent bearing faces of the tube is greater than 90 degrees.

Most advantageously, the corner post tube 11 is extruded from aluminum or other suitable material. As indicated in FIG. 1, the tube is of uniform cross-sectional configuration and is open at its upper and lower ends. An extension tube 14 of slightly smaller outside diameter than the inside diameter of tube 11 may be telescopingly received within the upper end of the main tube 11. In use, the extension tube 14 may be provided at its upper end with a fitting 15 for attachment to ceiling 16 and, since the telescoped tubes are hollow, electrical wiring may be disposed within the tubes for supplying electricity to outlets and equipment in the workspaces defined by a plurality of connected panels and corner post assemblies. In that regard, it will be observed that the lower end of the main tube 11 remains open and spaced above a floor surface in a completed installation (FIG. 2); therefore, electrical cables may be easily extended to the work stations through the bottom of that tube.

Figure 7:
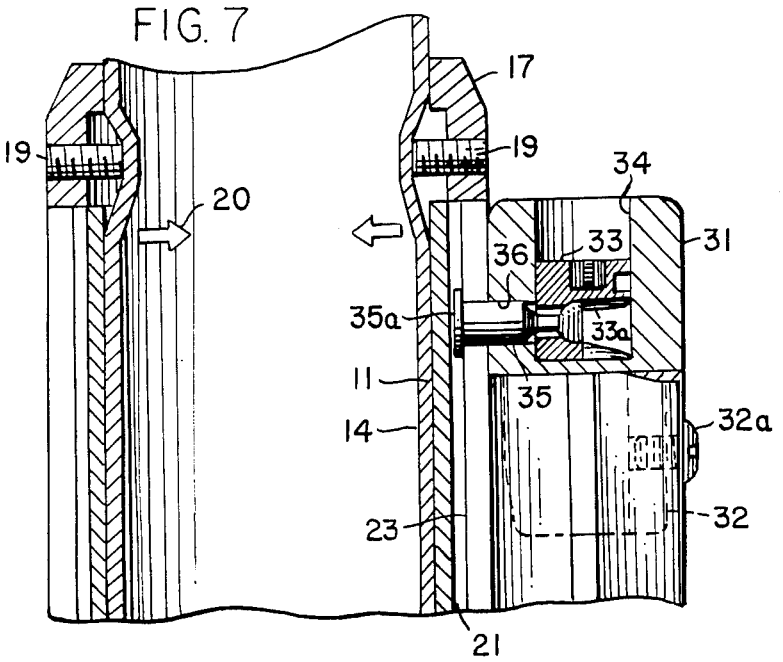
FIG. 7 is a fragmentary vertical sectional view at the upper end of the corner post assembly.

The two tubes are connected by a cylindrical collar 17 with an outer surface 17*a* having a diameter approximating the maximum cross-sectional dimension of tube 11 and an inner surface 17*b* having a diameter slightly larger than the outside diameter of extension tube 14. Diametrically disposed threaded openings 18 receive screws 19 that, when tightened, engage and indent opposite sides of the extension tube as shown in somewhat exaggerated form in FIG. 7. Tightening of the screws therefore locks the collar 17 and extension tube 14 tightly together. Of particular importance is the fact that such tightening of the screws also locks the collar 17 and main tube 11 against relative movement even though, when the screws are loosened, collar 17 simply rests upon the upper end of the tube 11 without any positive interconnection between the parts. The reason for the interlocking action between collar 17 and corner post tube 11 is that the diametrically-disposed screws 19, when tightened, deform the cylindrical extension tube 14 into slightly oval cross-sectional shape. A portion of the extension tube directly below screws 19 assumes a smaller diameter as the extension tube is deformed inwardly in the direction of arrows 20 (FIG. 7). In the cross direction (a horizontal direction at right angles to the direction of arrows 20), however, the extension tube is forced to expand, causing its outer surface to bear tightly against the inner surface of main tube 11. Therefore, screws 19 perform the dual functions of locking collar 17 to extension tube 14 and also, by deforming the extension tube, directly locking the extension tube and main tube 11 together.

Each face 13 of the corner post tube 11 has a vertical channel or keyway 21 formed therein. As shown most clearly in FIGS. 1 and 5, each channel 21 is externally accessible through a relatively narrow entry slit 22 defined by a pair of outwardly-extending side flanges 23. The side flanges are integral parts of the tube 11 and their outer surfaces define portions of the bearing faces 13 of the polygonal tube.

Each riser 12 includes a body portion 12*a* that, like corner post tube 11, may be formed by extrusion. The riser is of generally rectangular cross-sectional configuration having a longitudinal central cavity 25 and a pair of lateral cavities 26, the latter being open at opposite sides of the riser by reason of narrow vertical entry slits 27. Of particular importance is the fact that each riser has at least one planar side wall 28 of substantially greater width than any of the bearing faces 13 of the corner post tube. A suitable base member 29, preferably provided with an adjustable shoe 30, may be secured to the lower end of the riser body by any suitable means. At its upper end, the riser 12 is provided with a riser cap 31 having an insert portion 32 received in the open upper end of central cavity 25 and secured in that cavity by means of screw 32*a* (FIG. 7).

Each riser is constructed so that the means for attaching its upper end to the corner post tube is not readily apparent. Such means takes the form of a rotatable cam element 33 disposed within an upwardly-opening cylindrical socket 34 in riser cap 31 (FIGS. 1 and 7–10). Cam elements of the general type shown are well known and commercially available (e.g., Hafele America, High Point, N.C.), and a detailed discussion of their structure and operation is therefore believed unnecessary herein.

Figure 10:
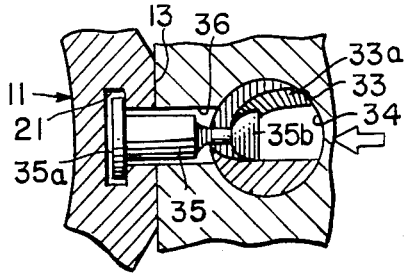
FIGS. 10 and 10A illustrate the relationship after the draw member is retracted or tightened.
Figure 10A:
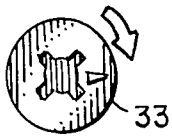

The rotatable cam element 33 cooperates with a double-headed draw member or draw pin 35. The shaft of the draw member extends through a horizontal bore 36 in the riser cap, such bore communicating with socket 34. One head 35*a* of the double-headed draw member is received within a channel 21 of the corner post tube 11 and the other head 35*b* is received within the cam recess 33*a* of rotatable cam element 33. Upon rotation of the cam element or member by means of a suitable tool, such as a screwdriver or hex wrench inserted into socket 33*b*, the draw member is cammed from an extended position (FIG. 9) into a retracted position (FIG. 10). FIGS. 9, 9A, 10, and 10A indicate the extent of angular movement (approximately 90 degrees) required to shift the draw member between its extended and retracted positions. If the cam element is rotated counterclockwise 90 degrees from the position indicated in FIGS. 9 and 9A, then complete disengagement between the pin and cam member may take place. The total range of angular movement between disengagement and complete retraction is therefore approximately 180 degrees.

The shank of the draw member 35 may extend through slit 22 and into channel 21 at any suitable point along the length of that channel, the particular location depending on the length of the riser 12 that is detachably connected to the corner post tube. Since the enlarged head 35*a* of the draw member 35 bears against the side flanges 23 of the tube 11 when the draw member is retracted, forceful retraction of the draw pin urges riser cap 31 and riser body 12*a* into tight frictional engagement with the bearing face 13 of the tube 11 that faces riser 12. More specifically, retraction of member 35 forces the planar wall 28 into firm planar engagement with the opposing face 13 of corner post tube 11 (FIGS. 7, 10).

The means for securing the lower end of riser 12 to the corner post tube 11 takes the form of a pair of lower support members 45 each having a total height constituting only a minor fraction of the height of tube 11. The two support members are identical in construction with the only difference, as shown in FIG. 1, being that in use their orientations are reversed. Each member 45 has a body portion 46 of generally triangular configuration when viewed in plan, a neck portion 47 projecting from one side of the triangular body portion, and a plate-like head portion 48. An integral threaded shaft 49 projects horizontally from an adjacent side 46*a* of the body portion 46 at a point intermediate the upper and lower ends of that body portion. Thus, retractive forces exerted upon shaft 49 may be transmitted substantially uniformly at both the upper and lower ends of the support member 45.

Figure 4:
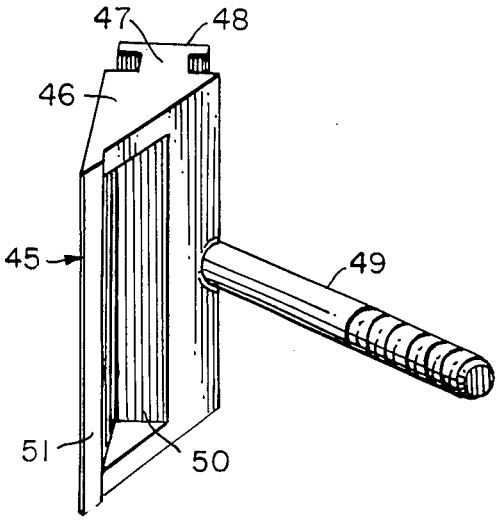
FIG. 4 is another enlarged perspective view of such a lower support member.

Side 46*a* defines a generally planar surface except for a recess 50 that may be provided for purposes of saving material cost and weight and, more significantly, except for a vertical lip 51 that protrudes from side surface 46 along the full height thereof (FIG. 4). The threaded shaft 49 of each lower support member extends through a horizontal opening 52 formed in the lower end of riser body 12*a* (FIG. 1). The two openings 52 are spaced laterally apart and are equidistant from the vertical midline of riser 12 that intersects the axis of draw member 35 at the upper end of the riser. Nuts 49*a* receive the threaded shafts and may be tightened or loosened to retract or extend those shafts during a connecting operation.

The two lower support members 45 have their head portions 48 received in channels 21 of the corner post tube 11 that are immediately adjacent to, and on opposite sides of, the channel 21 in which the upper draw member 35 is received. As shown in FIG. 5, the triangular configuration of the body portion 46 of each lower support member is dimensioned to occupy the triangular spaces at the lower end of the riser between the riser's planar wall 28 and the bearing faces 13 in which the channels 22 receiving head portions 48 are formed. Therefore, a triangulation effect occurs as the two lower support members and the upper draw member are retracted. The forces exerted by such members securely anchor the riser 12 and support tube 11 together with their opposing surfaces 28 and 13 in tight engagement. Also, since the triangular-shaped lower support members occupy the triangular spaces at the lower end of the riser, a bracing action occurs that effectively resists relative twisting forces that might be exerted upon the corner post tube 11 and riser 12, respectively.

Figure 6:
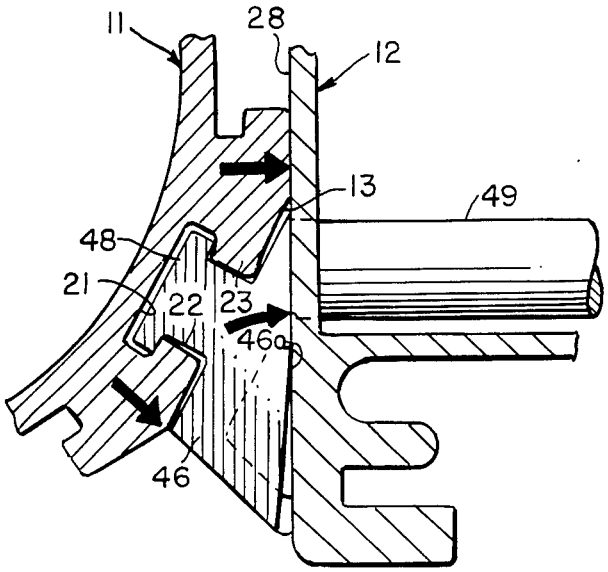
FIG. 6 is a fragmentary cross sectional view illustrating in somewhat exaggerated form the actions that are believed to occur when a lower support member is fully tightened.

FIGS. 5 and 6 reveal that an intentional deformation occurs as the lower support members 45 are fully tightened. Referring to FIG. 5, the support member shown at the upper part of that figure is depicted in loosened condition with its face 46*a* spaced from planar surface 28 of the riser. In that condition, head portion 48 is freely slidable in channel 21. The support member 45 shown in the lower part of the same figure is depicted in partially retracted or tightened (finger tightened) condition with its lip 51 engaging surface 28 but with the remainder of face 46*a* spaced from surface 28.

FIG. 6 reveals what is believed to occur as a lower support member 45 is fully tightened. A pivoting of the triangular body portion 46 occurs about the line of contact between lip 51 and surface 28 to bring a major portion of the planar surface 46*a* into engagement with surface 28. The same action produces a canting of head portion 48 within channel 21. The head portion, although freely slidable in channel 21 when nut 49*a* is loosened, produces a jamming action that securely anchors the parts together when the nut is tightened. Points of forceful contact are indicated by the arrows in FIG. 6.

FIGS. 11–13 illustrate various ways in which risers may be connected to a corner post tube. In the embodiment illustrated, the maximum number of risers that may be so connected is 4, with adjacent risers, and the frames or panels P connected to them, disposed 90 degrees apart. By reducing the number of risers to 3, the angular distances may be increased to 120 degrees (FIG. 13), or the 3 risers may be arranged at different angular distances of 90, 120, and 150 degrees apart (FIG. 12). For a corner post tube 11 having the 12-sided polygonal cross-sectional configuration depicted in the drawings, any 2 risers may be secured to the tube at angular increments that are multiples of 30 degrees but not less than 90 degrees.

Assembly of the parts may be easily accomplished by simply inserting the enlarged head 35*a* of the upper draw member 35 into a channel 21 of tube 11 from the open upper end of that channel and inserting the heads 48 of the lower support members into adjacent channels 21 from the lower ends of those channels. Threaded shafts 49 are inserted through openings 52 in the riser, nuts 49*a* are fitted upon the threaded shafts, and the corner post tube and riser are then slid vertically into their final positions of adjustment. Cam element 33 is rotated to retract the upper draw member 35 and nuts 49a are tightened to fully retract lower support members 45. Access to nuts 49a is easily obtained because such nuts are exposed beneath panels P or, if not exposed, are readily accessible through openings in the undersides of such panels.

With regard to the accessbility of nuts 49a, it has already been stated that shafts 49 on which such nuts are threaded should be joined to the body portions 46 at points midway between the upper and lower ends of those body portions. The short length (height) of each body portion therefore assumes additional significance relating to the accessibility of the lower connecting members for purposes of adjustment. In general, it has been found that the body portion 46 of each support member 45 should not exceed 6 inches in height and that preferably such height should fall within the range of about 1 to 3 inches.

While in the foregoing, I have disclosed an embodiment of the invention in considerable detail for purposes of illustration, it will be understood by those skilled in the art that many of these details may be varied without departing from the spirit and scope of the invention.

I claim:

1. A corner post assembly comprising a straight, vertically-extending, corner post tube having a plurality of outer bearing faces which, when viewed in a horizontal cross-section of said tube, define a regular polygon in which the included angles between adjacent faces are equal and obtuse; said faces having a plurality of vertical channels formed therein with each channel being externally accessible through a relatively narrow entry slit extending along and between a pair of vertical side flanges; a vertical riser extending along at least a portion of the length of said tube and having a planar side wall facing said tube; upper connecting means for releasably joining the upper end portion of said riser to said tube; said upper connecting means comprising a draw member movably carried by said upper end portion of said riser for horizontal movement between extended and retracted positions; said draw member projecting through said entry slit of one of said channels and having an enlarged head portion disposed within said one channel; said head portion being slidable in said one channel when said draw member is extended and, when said draw member is retracted, bearing against side flanges to urge said bearing face in which said one channel is formed against said planar wall of said riser; and lower connecting means for releasably joining the lower end portion of said riser to said tube and for stabilizing said tube and riser against relative twisting movement when connected; said lower connecting means comprising a pair of laterally-spaced support members projecting through entry slits for two of said channels in said tube immediately adjacent said one channel and along opposite sides thereof; said support members each being mounted upon said riser at the lower end thereof for movement between extended and retracted positions; said support members having head portions received in said two channels; said head portions of said support members being slidable in said two channels when said support members are extended and tightly engaging the side flanges of said two channels when support members are retracted; whereby, said draw member and said support members engage said tube at three traction zones to hold the bearing face of said one channel tightly against said planar wall of said riser when said draw member and said support members are retracted.

2. The assembly of claim 1 in which each of said support members includes a body portion and a threaded shaft portion; said body portion having a planar surface engagable with said planar wall of said riser when said support member is retracted.

3. The assembly of claim 2 in which said threaded shaft extends from said body portion at a midpoint between the upper and lower limits thereof.

4. The assembly of claim 3 in which said riser is provided with a pair of laterally-spaced horizontal openings for receiving the threaded shaft portions of said lower support members; and nuts threadedly receiving said shaft portions and engagable with said riser for extending and retracting said lower support members.

5. The assembly of claim 2 in which each body portion is provided with a vertical lip extending along an edge of said planar surface; said lip being engagable with the planar wall of said riser when said support member is retracted to pivot said body portion into surface contact with said planar wall.

6. The assembly of claim 2 in which the height of each body portion is a minor fraction of the height of said corner post tube.

7. The assembly of claim 6 in which the height of said body portion is no greater than 6 inches.

8. The assembly of claim 7 in which the height of said body portion falls within the range of about 1 to 3 inches.

9. The assembly of claim 1 in which said upper connecting means includes a rotatable cam element engagable with said draw member for retracting and extending said draw member.

10. The assembly of claim 9 in which said riser includes a riser cap at the upper end thereof; said riser cap having an upwardly-opening socket rotatably receiving said cam member.

11. The assembly of claim 1 in which said corner post tube has an open upper end and a cylindrical extension tube is telescopingly received in said corner post tube through said open upper end; an annular mounting collar receiving said extension tube and resting upon said corner post tube at the open upper end thereof; and screw means extending radially through at least one threaded opening in said collar for forceably engaging said extension tube and deforming the same to jam said extension tube within said corner post tube.

12. The assembly of claim 1 in which said corner post tube has 12 of said outer bearing faces; whereby, two of said risers may be connected to said corner post tube at angular distances that are multiples of 30 degrees but not less than 90 degrees.

* * * * *